United States Patent [19]

Tomlin

[11] Patent Number: 4,921,306

[45] Date of Patent: May 1, 1990

[54] MINING MACHINE AND METHOD UTILIZING INTENSIFIER FOR HIGH AND LOW WATER PRESSURE TO CUTTING DRUM

[75] Inventor: Malcolm G. Tomlin, Swadlincote, England

[73] Assignee: Coal Industry (Patents) Limited, United Kingdom

[21] Appl. No.: 260,122

[22] Filed: Oct. 20, 1988

[30] Foreign Application Priority Data

Dec. 10, 1987 [GB] United Kingdom ..... 8728919

[51] Int. Cl.[5] ..... E21C 25/60; E21C 35/22

[52] U.S. Cl. ..... 299/17; 239/101; 239/436; 299/81

[58] Field of Search ..... 299/12, 17, 81; 239/99, 239/101, 436, 443

[56] References Cited

U.S. PATENT DOCUMENTS 3,799,615 3/1974 Taylor et al. ..... 299/81 X
3,857,516 12/1974 Taylor et al. ..... 239/101 X
4,648,859 3/1987 Masovich ..... 299/81 X

FOREIGN PATENT DOCUMENTS 3626135 2/1988 Fed. Rep. of Germany ..... 299/17

*Primary Examiner*—Stephen J. Novosad
*Assistant Examiner*—David J. Bagnell
*Attorney, Agent, or Firm*—Stevens, Davis, Miller & Mosher

[57] ABSTRACT

In a mineral mining machine of the shearer drum cutter loader type, a system for supplying water at the required pressures includes an intensifier to which in use mine supply water is fed, the pressure being enhanced in the high pressure chambers and the high pressure water being fed to jets on the end of the cutting drum. Water exhausting from the low pressure chambers is fed to the dust and frictional sparking suppression sprays arrayed along the surface of the cutting drum. The method of the invention consists of generating in a simple and effective manner the requisite water pressures utilizing an existing main supply.

7 Claims, 1 Drawing Sheet

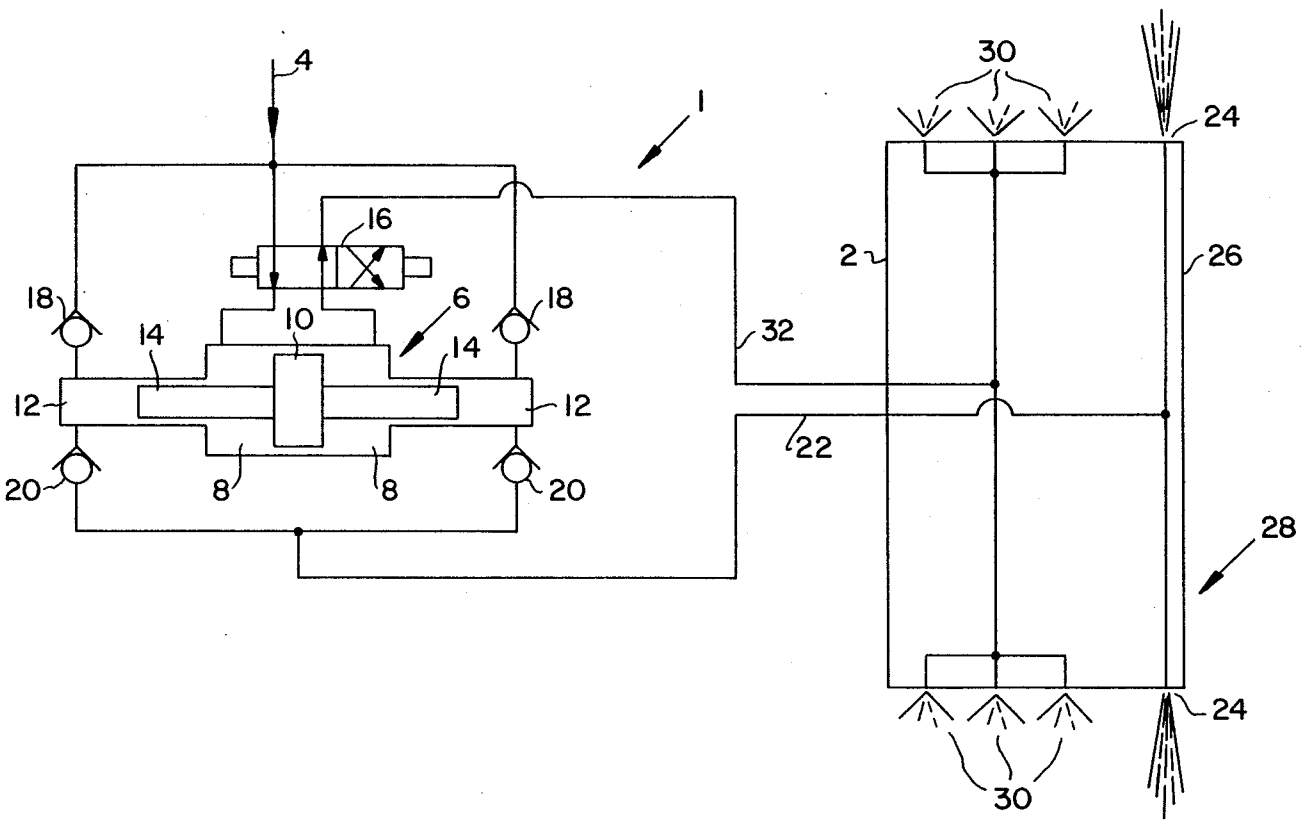
28
24
26
24
30
30
2
22
32
1
18
12
20
6
14
16
8
4
10
8
14
18
12
20

MINING MACHINE AND METHOD UTILIZING INTENSIFIER FOR HIGH AND LOW WATER PRESSURE TO CUTTING DRUM

BACKGROUND OF THE INVENTION

This invention concerns improvements in or relating to mineral mining machines, particularly, but not exclusively, of the kind known as shearer drum cutter loaders.

Such machines are used extensively in coal mining wherein they are arranged to travel reciprocally within a seam to win coal from a longwall face. In the course of the winning operation, dust is generated by the impact of the cutting picks on the coal. It has long been the practice to utilize water sprays to suppress the dust to make the working environment more acceptable, the sprays being mounted adjacent the cutting picks which are arranged in an appropriate lacing pattern on scrolled loading vanes secured to the surface of the drum. It is also common practice to provide on the face end of the drum a clearance ring which has mounted thereon high-pressure water jets for the purpose of assisting the cutting operation itself. These particular jets reduce the cutting forces on the picks, thus allowing either faster cutting rate to be achieved or a reduction in the number of picks on the clearance ring resulting in the production of smaller amounts of fine coal.

The deployment of high-pressure water sprays in the manner described also yields a significant decrease in the amount of respirable dust produced, a reduction in pick wear and lower transient loading of the machine components caused by vibration. However, the major problem attendant upon their usage is that of supplying the water at sufficient pressure to be effective. There is normally insufficient surplus power available to drive a high-pressure pump from the shearer electric motor, and space limitations preclude the provision of an independently driven on-board pump. Equally, a pump located remotely from the shearer is impractical because of the safety problems associated with feeding high-pressure hose along the coal face.

The relatively lower pressure water sprays disposed adjacent the picks across the surface of the cutting drum for dust and frictional sparking suppression are usually supplied with water from the mine water supply, but this is normally at too high a pressure owing to the hydrostatic head caused by the depth of the mine workings. Depressurization is, therefore, necessary before feeding the water to the cutting drum.

SUMMARY OF THE INVENTION

It is therefore an object of the present invention to provide a method of supplying water at the required pressures to a cutting drum of a mineral mining machine.

It is a further object of the invention to provide a mineral mining machine incorporating a system for carrying out the method.

According to a first aspect of the invention a method of providing water at the required pressures to a cutting drum of a mineral mining machine includes the steps of feeding a supply of water to an intensifier wherein the pressure of the water is intensified in the high pressure side of the intensifier and the high pressure water is fed to one part of the cutting drum, and the water exhausting from the low pressure side of the intensifier is fed to another part of the cutting drum.

Conveniently, the water fed to the intensifier is in practice the mine water supply, the water being ducted to both the high pressure and the low pressure sides of the intensifier. In the event that the mine water supply pressure is too low for the intensifier, a boost pump can be incorporated upstream of the intensifier.

Preferably, the high pressure water is fed to the picks mounted on a clearance ring on the face end of the cutting drum.

According to a second aspect of the invention there is provided a mineral mining machine incorporating a system for carrying out the method, the system including a feed line, a control valve, an intensifier having high pressure and low pressure chambers to each of which water is fed from the feed line, the control valve controlling the feed to the low pressure chamber, a plurality of low pressure water sprays disposed on one part of the drum to which the water exhausting from the low pressure chambers is fed, and a plurality of high pressure jets located on another part of the drum to which the water discharged from the high pressure chamber is fed.

The intensifier is preferably of conventional design having a central large diameter piston moving in the low pressure chamber, with two smaller end pistons moving in the high pressure chambers, non-return valves being provided for the inlet and outlets of the high pressure chambers.

A plurality of intensifiers may be provided in the system and may be arranged to feed water to more than one cutting drum on the machine.

The system is such that simultaneously, high pressure water is generated for the jets mounted at the end of the cutting drum on the clearance ring, and lower pressure water is provided for the dust and frictional sparking suppression sprays arrayed across the surface of the drum.

By way of example only, a method of supplying water at the required pressures to a cutting drum of a mineral mining machine and a machine incorporating a system for carrying out the method according to the invention are described below with reference to the accompanying drawing which illustrates the system diagrammatically.

BRIEF DESCRIPTION OF THE DRAWING

The single FIGURE is a diagrammatic showing of an intensifier, a cutting drum and connecting water circuits.

DESCRIPTION OF THE PREFERRED EMBODIMENT

Referring to the drawing, there is shown a water supply system 1 for mineral mining machine only a cutting drum of which is indicated at 2. The system 1 includes a supply line 4, which in practice would be the mine water supply, feeding an intensifier 6 comprising a low pressure chamber 8 in which is reciprocally mounted a double-faced piston 10, and two high pressure smaller diameter chambers 12 leading from the chamber 8, each housing a piston 14 connected to the piston 10. A control valve 16 is interposed in the line 4 and serves to control the water flow to the chamber 8, non-return inlet and discharge valves 18, 20 being provided for the high pressure chambers 12 which discharge into a feed line 22 connected to jets 24 mounted on a clearance ring 26 at the face end 28 of the drum 2. Lower pressure water sprays 30 arrayed around and along the drum 2 are supplied with water exhausting through line 32 connected to the control valve 16.

In operation, mine supply water enters the system 1 through the line 4 at a pressure of typically 100 bar at a rate of about 200 l/min, and feeds both the low pressure chamber 8 and the high pressure chambers 12. In the position of the valve 16 as shown in the drawing, water is fed to the left hand side of the chamber 8 and exerts pressure on the piston 10 causing it to move to the right. In so doing, low pressure water at about ten to twenty bar, depending on the number of sprays fitted and their diameter, on the right hand side of the piston 10 is exhausted from the chamber 8 and into the line 32 leading to the sprays 30. The movement of piston 8 to the right also has the effect of intensifying the pressure of water previously drawn into the right hand chamber 12 through the non-return valve 18, discharging the same through the valve 20 into line 22 to issue from the jets 24, as indicated diagrammatically. At the same time, water is induced into the left hand chamber through valve 18 from the line 4, the valve 20 being closed. When the piston 10 reaches the end of its stroke, the cross-over valve 16 is activated to change position and such activation can be achieved in any convenient manner, for example mechanically, hydraulically or electrically. The movement of the piston 10 then reverses, with high pressure water discharging from the left hand chamber 12 and low pressure water exhausting from the left hand side of the chamber 8, into the respective lines 22,32.

The intensifier 6 of the system 1 is reciprocal and thus provides continuous supply of water to the sprays 30 and the jets 24. In the example, with a 4:1 intensification ratio, of the 200 l/min supply, 40 l/min at a pressure of 400 bar would be fed to the jets 24 and 160 l/min would be fed to the sprays at a pressure of between 10 and 20 bar. It will be understood that the inlet pressure of the mine water supply is by way of example only, since it will vary depending upon the depth of the workings. Furthermore, the intensification ratio can be varied according to requirements.

The invention thus provides a simple yet effective method of generating the requisite water pressures using an existing mains supply, without the need to adopt expensive and complex systems.

I claim:

1. A method of providing water at the required pressures to a cutting drum of a mineral mining machine including the steps of feeding a supply of water to an intensifier;

intensifying the pressure of the water in the high pressure side of the intensifier;

feeding the high pressue water to one part of the cutting drum;

exhausting the water from the low pressure side of the intensifier, and feeding the water from said low pressure side to another part of the cutting drum.

2. A method according to claim 1 in which the water fed to the intensifier is in use the mine water supply, including ducting the feed water to both the high pressure and the low pressure sides of the intensifier.

3. A method according to claim 1 including feeding the high pressure water to jets mounted on a clearance ring on the face end of the cutting drum.

4. A mineral mining machine incorporating a system for carrying out a method of providing water at the required pressures to a cutting drum of a mineral mining machine which feeds a supply of water to an intensifier, intensifies the pressure of water in the high pressure side of the intensifier, feeds the high pressure water to one part of the cutting drum, exhausts the water from the low pressure side of the intensifier, and feeds the water from the said low pressure side to another part of the cutting drum, wherein the system comprises a feed line;

a control valve;

an intensifier having high pressure and low pressure chambers and means to feed water from the feed line;

a control valve controlling the feed to the low pressure chamber;

a plurality of low pressure water sprays disposed on one part of the drum to which the water exhausting from the low pressure chambers is fed;

and a plurality of high pressure jets located on another part of the cutting drum to which the water discharged from the high pressure chambers is fed.

5. A machine according to claim 4 in which the intensifier comprises a central large diameter piston moving in the low pressure chamber and connected to two smaller diameter pistons mounted for moving in the high pressure chambers and non-return valves provided for the inlets and the outlets of the high pressure chambers.

6. A machine according to claim 4 in which a plurality of intensifiers are provided in the system.

7. A machine according to claim 4 in which the intensifier supplies water to more than one cutting drum.

* * * * *